United States Patent [19]

Barghout et al.

[11] 4,089,633

[45] May 16, 1978

[54] COMBUSTION VAPOR GENERATOR

[76] Inventors: Alexander S. Barghout, 52 Whittier Rd., Milton, Mass. 02186; Richard A. Washak, 47 Wachusett Rd., N. Weymouth, Mass. 02191

[21] Appl. No.: 671,268

[22] Filed: Mar. 29, 1976

[51] Int. Cl.[2] ..... F23J 7/00

[52] U.S. Cl. ..... 431/208; 261/18 A; 431/3; 431/4

[58] Field of Search ..... 431/4, 3, 126, 190, 431/208, 11, 217; 261/18 A

[56] References Cited

U.S. PATENT DOCUMENTS

| | | | |
|---|---|---|---|
| 3,075,577 | 1/1963 | Cazalas | 431/4 |
| 3,862,819 | 1/1975 | Wentworth | 431/4 |
| 3,901,644 | 8/1975 | Armias | 431/217 |
| 3,924,648 | 12/1975 | Etter | 431/4 X |
| 3,941,552 | 3/1976 | Cottell | 431/2 |

*Primary Examiner*—Edward G. Favors

[57] ABSTRACT

A device in connection with a combustion system using fossil fuels which introduces a controlled amount of water vapor bearing trace amounts of selected carbon removing cleaning agents for improving efficiency.

7 Claims, 3 Drawing Figures

COMBUSTION VAPOR GENERATOR

This invention relates to combustion systems, and more particularly, to a device which is coupled to a heating system which introduces controlled amounts of moisture which has trace amounts of soot and carbon removing agents for improving the effeciency of the combustion and heating system and permit it to retain optimum performance over extended periods of time, with also a reduction in smoke count and consequent reduction of the pollution of the air.

It is well known and documented that fossil fuel burners (oil, coal, wood, waste or gas jet) work more effectively when the relative humidity of the air beint supplied to the combustion device is at a high level. The present invention is directed to a device which can guarantee or assure that the relative humidity will remain at a high level by introducing moisture vapor and chemicals which is drawn into the combustion chamber whereby the performance of the oil burner, coal furnaces, gas fired unit, and wood furnaces is improved. Prior art devices recoganize the improved operation via the introduction of humid air; however, they fail to produce a device where they could control precisely and in such a manner the amount of moisture vapor with chemicals entering the system was predictable over an extended period of time. The present inventors have discovered that introducing effectively a device which generates a fixed amount of moisture and vapor chemicals, of energy to the water, raising its level whereby the amount of moisture vapor generated is increased. The amount generated is therefore precisely controllable.

Studies have determined that heating plants when adjusted and cleaned within a very few days or weeks produce a carbon and soot build-up in the system. Carbon and soot coat the heating surface and acts as an insulator. Of course it can also build-up to a point where it blocks or creates an impeachment to the openings of the flue and hamper the operation of combustion controls. The present inventors have discovered that the introduction of trace amounts of carbon and soot removing chemicals can prevent this build-up over an extended period of time.

Prior art devices require extensive service and are quite delicate. The present invention is self contained, automatic and requires no service except for an occasional addition of oil solution of carbon and soot removing chemicals.

Therefore an object of the present device is to introduce controlled amounts of moisture to combustion.

Another object of the present invention is to provide a device which introduces trace amounts of soot and carbon removing chemicals to combustion.

Another object of the present invention is to produce a service free, automatic, moisture producing, carbon and soot destroying combustion device.

Another object of the present invention is to produce a device which cleans the air passage in oil burners.

Other objects features and advantages of the present invention will be better understood from the following detailed specification when read in conjunction with the attached drawing of which:

Figure 1:
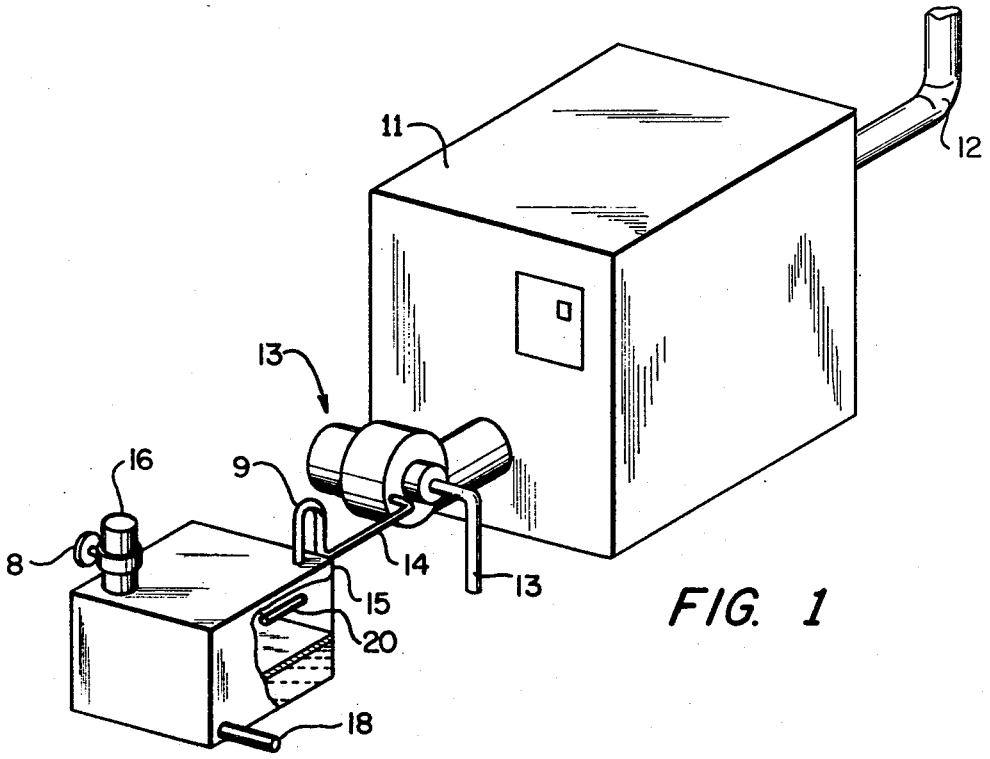
FIG. 1 is a view of the present invention.

Referring now to FIG. 1 we see a heating system with a boiler 11 and smokestack 12, together with an oil burner 13. We see the present invention being applied to the system by way of the pipe 14, which emanates from a container 15. A jet spray bar 20 across the upper inner section of the unit is connected by way of 22 and motorized pump 17 to the spray bar, picking up water 25 at the bottom of the container. Motorized pump 17 which is wired electrically to a power source which energizes the oil burner and forces the water through spray bar 20 into jets 23 with sufficient force to penetrate the chemical layer 24 floating on water 25. The agitation of the water causes bubbles to appear on the entire surface of 24 which contain aerated water with traces of the chemical oil solution. Many of these bubbles are released to the atmosphere of the container immediately above 24, and by way of lead pipe 14 is drawn by means of the primary air intake of the oil burner into the combustion chamber of the heating system 11. Vacuum relief valve 16 permits the atmosphere to be purged drawing out humid air by way of induced draft of the primary air intake of the oil burner into the combustion chamber. Larger units will have a fan which will induce a greater flow of moist air to suppliment the primary air intake demands of the oil burner and natural draft. Pipe 14 can alxo be positioned in close proximity to the side of the oil burner 13 and will be drawn in by natural draft or with a fan inducer added, both arrangements work equally well.

The moisture and chemical once in the combustion chamber mixes with the air oil combustion mixture increasing the system traces of the chemical 24 which constantly removes carbon and soot that would ordinarily be building up in the heating system.

Figure 2:
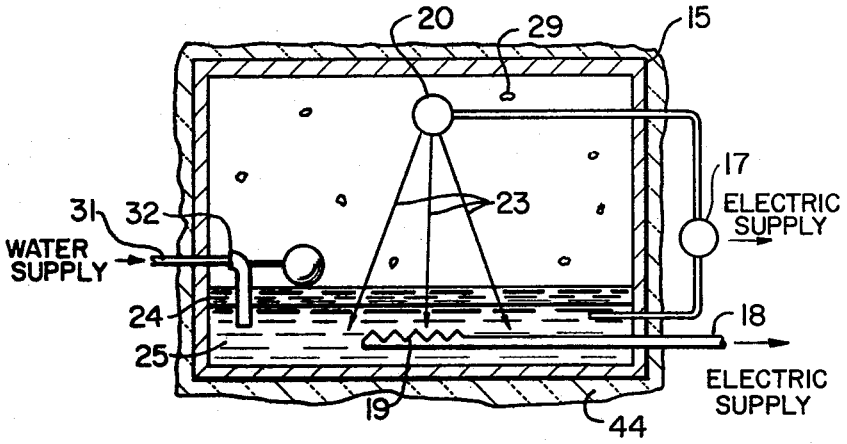
FIG. 2 is a more detailed view of the moisture geneator.

Referring now FIG. 2 we see in detail vessel 15. We see three or more streams 23 eminating from spray bar 20. We also see that they penetrate deeply into the water 25, and the film of oil 29 floating on top. We also see that the atmosphere in vessel 15 is filled with bubbles of air, water and traces of oily chemical 29 which will be available when drawn into the combustion chamber. We note that water lead 31 which is connected to a water supply is controlled by an automatic float mechanism 32, and located in the water chamber thus keeping the water at a regulated level with a back float preventer 43.

Causing the water to be vaporized in a trouble free manner is done in the present case keeping control in this manner: The force of water jets is fixed by the rate of the pump, (eliminating an expensive variable speed pump which could control the pressure on a variable scale) the amount of moisture released is proportioned to the combustion by permitting the pump to come on when the oil burner comes on, therefore the agitation by way of the jets is controlled at a fixed rate. In order to fine tune or control the amount of vaporization it was found desirable to heat the water by way of heating coil 19 which is wired to an electrical supply 18 just as the pump is, but remains on all the time. This heater can be controlled by way of a thermostat 41, which sets the electricity off and on to the heater, we know then that the energy within the particles of water will be greater or less depending upon the amount of heat being introduced into the container. Therefore, it is a considerable advantage to add heating to the vessel liquid to control the amount of vaporization in combination with the agitation produced by the jets impinging on the chemical surface. Examining the open vessel one would find the entire chemical surface filled with a formation of foaming bubbles of air that were caused by the trapping of air as the jets impinged on the chemical. These agitated bubbles with chemicals and water permit the particles of water to be released into the atmosphere 29. These contain small particles of water with trace amounts of the carbon and soot removing chemicals which when entered into a heating system will cause the combustion to burn any unwanted carbon or soot deposits that quite often build up.

Numerous studies have indicated that oil burners must be adjusted very carefully. However, the prevention of carbon and soot build up poses another problem. With the present invention the amount of chemicals and type of chemicals introduced to the heating system eliminates the problem of carbon and soot build-up.

Figure 3:
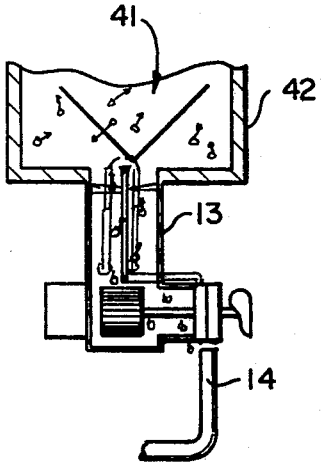
FIG. 3 is a view of combustion flame in a chamber.

Vaporized moist air which enters the combustion chamber shown in FIG. 3 expands rapidly and in proportion to the temperature of the chamber. A reduced updraft pressure develops which prevents surplus air from entering the system when not needed at high temperatures. The moist vapor then regulates automatically the entry of surplus air over a wide range of combustion chamber temperatures. The particles of chemical and water also assist in breaking up the particles of fuel oil because the turbulence and rapid expansion of the vaporized chemical and water particles permit further atomization of the fuel oil through the turbulence and agitation created by the particles of chemical and water which instantly maximizes for complete combustion in the chamber. Accordingly, controlling or reducing the amount of surplus air when not needed at a time when the combustion chamber is at a very high temperature; atomizing the oil more fully; and adding trace amounts of carbon and soot remover constantly, an over-all efficiency is attained greater than anything attained in the prior art, especially on a long term basis.

It will be observed with the present invention that for example a burner nozzle firing into a chamber is easily filled with flame with a much smaller size than previously, demonstrating the increased atomization and therefore complete combustion of the oil spray by the addition of chemical and water vapor theretofore not achieved in the prior art. The present invention improves the performance of all types of combustion devices in a similar manner to oil by insuring complete combustion.

The vessel because it is heated electrically or by heat exchanger with a steam or hot water from the heating plant is best insulated with insulation 44. Insulation is added to the supply hose 14, preventing further condensation. In order to further regulate the amount of moist chemical vapor entering the combustion, a valve 8 has been introduced to the column relief system and the flow of chemical moist vapor is thereby controllable.

A typical chemical composition used successfully is as follows:

| | |
|---|---|
| Isoparrafinic Hydrocarbous | 89.74 |
| Metallic Catalyst | 8.00 |
| Metallic Salt | 2.00 |
| Aromatics | .25 |
| Coloring Matter | .01 |
| | 100. % |

The metallic salts obviously attack the carbon and soot and are soluable in oil which burns off during combustion.

Although we have described our invention with reference to specific apparatus we do not wish to be limited thereby, we only wish to be limited by the appended claims of which:

We claim:

1. A vapor generator for combustion improvement comprising, a vessel of water, means for maintaining the level of said water, oily chemical solution for forming a layer on said water, pump means for drawing water from the bottom of said vessel to the top of vessel under pressure, jet spray means for receiving said pumped water and spraying jets into the oily chemical solution covered water whereby bubbles of water, air and trace amounts of chemicals are released into the atmosphere of said vessel, means for conducting said vapor filled air to the intake of a burner firing a combustion chamber to aid in the combustion of fossil fuels.

2. A vapor generator according to claim 1 which further includes heater means for controlling the water temperature whereby the vaporization rate is raised.

3. A vapor generator according to claim 2 which further includes a vapor trap to dry the output vapor.

4. A vapor generator according to claim 3 which further includes means for inducing the flow of the atmosphere into the combustion chamber.

5. A vapor generator according to claim 4 wherein said oily chemical solution is soot and carbon removing chemicals dissolved in oil.

6. A vapor generator according to claim 5 which further includes means for regulating the flow of vapor out of the vessel.

7. A vapor generator according to claim 6 wherein said chemicals contains dissolved metallic salt and metallic catalysts.

* * * * *